US007389755B2

(12) United States Patent
Noland

(10) Patent No.: US 7,389,755 B2
(45) Date of Patent: Jun. 24, 2008

(54) TANDEM-PISTON ENGINE

(76) Inventor: Ronald Dean Noland, 2334 State Highway NN, Advance, MO (US) 63730-9077

( * ) Notice: Subject to any disclaimer, the term of this patent is extended or adjusted under 35 U.S.C. 154(b) by 0 days.

(21) Appl. No.: 11/481,494

(22) Filed: Jul. 5, 2006

(65) Prior Publication Data

US 2007/0017478 A1 Jan. 25, 2007

Related U.S. Application Data

(60) Provisional application No. 60/701,066, filed on Jul. 21, 2005.

(51) Int. Cl.
*F02B 33/10* (2006.01)

(52) U.S. Cl. ..... 123/68; 123/70 R; 123/71 R

(58) Field of Classification Search ..... 123/66, 123/68, 70 R, 71 R, 197.2, 197.3, 78 B, 78 BA, 123/196.3

See application file for complete search history.

(56) References Cited

U.S. PATENT DOCUMENTS 5,421,293 A * 6/1995 Noltemeyer et al. .... 123/74 AC
5,509,382 A * 4/1996 Noland ..... 123/66
5,908,012 A * 6/1999 Endoh ..... 123/48 B

* cited by examiner

*Primary Examiner*—Hai H Huynh

(57) ABSTRACT

The piston rod of the tandem-piston engine was modified to include a crosshead that slides in a crosshead guide machined into the lower part of the charger piston for better lateral support. The lower surface of the motor piston was changed to a simple conical surface allowing increased vertical thickness of the central region with a thinner outer region. A ceramic piston crown was clamped in compression by a piston bezel to the motor-piston base at a ledge with a conical upper surface having its vertex at the center of its base so thermal expansion will effect a sliding contact. A piston ring was used at the upper edge of the motor piston so the uppermost cylinder wall will be polished to prevent heat absorption. An intake port was given a flame arresting diffuser; and its entrance was blocked by the piston valve to prevent ignition in the valve cylinder.

2 Claims, 7 Drawing Sheets

TANDEM-PISTON ENGINE

CROSS-REFERENCE TO RELATED APPLICATIONS

Provisional Application No. 60/701,066 filed Jul. 21, 2005 by Ronald Dean Noland titled Tandem-Piston Engine

STATEMENT REGARDING FEDERALLY SPONSORED RESEARCH OR DEVELOPMENT

Not applicable

BACKGROUND OF THE INVENTION

My invention relates to internal-combustion engines of the type employing a motor piston that reciprocates in a cylinder while turning a crankshaft for the extraction of motive power from the expansion of hot gases produced by the combustion of a compressed fuel-air charge that is supplied under pressure to a combustion chamber by a charger piston. A type fitting into the broad classification of two-stroke pump-compression cycle internal-combustion engines.

Currently, most heat engines in use for mechanical power generation are of the four-stroke cycle type that was patented by Alphonse Beau de Rochas in 1862 and adapted for manufacture and practical use in 1876 by Nicolaus August Otto. These engines have been very successful for over a century and they are still the standard of comparison. Their mode of operation appears quite logical; but they do not make maximum use of the heat that is generated by the combustion of a fuel-air charge. And the various two-stroke cycle gasoline engines in current use suffer from the same problem. In the four-stroke Otto cycle, a fuel-air mixture is drawn into a cylinder having a combustion chamber into which the mixture is compressed by a piston. The fuel-air mixture is then ignited, and the heat released from burning the fuel greatly increases the pressure of the resulting gases by raising them to a very high temperature. The extremely hot high-pressure gases then push the piston down to turn the crankshaft and do work. But paradoxically, in Otto cycle engines all parts of the combustion chamber must be kept reasonably cool. If they are not cooled, heat absorbed from the burning gases during the power strokes will increase the temperature of the parts until something becomes so hot that it will ignite the fuel-air charge during the induction stroke. Ignition then results in a backfire explosion through the intake manifold that prevents the successful completion of the cycle. But even before any part becomes that hot, there will be preignition during the compression stroke that is likely to cause power loss, detonation and overheating of the piston and valves that can destroy the engine. Since it is essential that the combustion chamber of these engines be kept cool, it is necessary to incorporate an air or liquid cooling system that usually adds substantially to their bulk and complexity and detracts from their reliability. However, the combustion and expansion phase of the cycle would be far more efficient if it were to be conducted using a very hot insulated chamber. Then the extremely hot high-pressure combustion gases would not as quickly transfer the heat, which produced and maintains the high pressure, to the internal parts of the combustion chamber. These include the cylinder head, the valves, the piston crown, the spark plug and the exposed part of the cylinder wall.

An answer to the problem might be to induct only air and then inject the fuel into it after it is compressed, as in a Diesel engine. This will solve the preignition problem; however, if the parts in the combustion chamber are allowed to become very hot, the air will be heated and expanded as it enters the cylinder, so less air will enter. This will reduce the mass of air available for combustion. Also, if the air is being heated by the chamber surfaces while being compressed, more work must be expended to compress it. The efficiency then is likely to get worse instead of better as was shown by the research in the Adiabatic Engine Program.

Since a cool chamber is needed for induction, but a hot chamber is needed for expansion, a new approach is necessary before the thermal efficiency can be raised to a much higher level. The dilemma can be resolved by making an engine that inducts and compresses its fresh charge in a separate cavity. Then, at the proper time, the fresh charge is forced into a combustion chamber, which is insulated and kept very hot, for combustion and expansion. This will slow the rapid loss of heat from the combustion gases so that the pressure does not drop as fast while the piston is being pushed down. If less heat is lost, a higher expansion ratio can then be used to extract more mechanical energy from the heat energy.

The only way that it is possible to increase the indicated thermal efficiency of internal-combustion piston engines is to reduce the amount of heat wasted. This is true regardless of whether the waste is from incomplete combustion, forced convection followed by conduction through the chamber surfaces or out the exhaust pipe following a low ratio expansion. Increasing the expansion ratio will be of limited benefit in four-stroke spark-ignition engines where purging of heat from the combustion chamber is practiced because it is intrinsically necessary. And it is unlikely that the mechanical efficiency will ever be much improved while a four-stroke engine requiring two revolutions per cycle, an extensive valve train and a mechanically pumped and fanned liquid cooling system is used.

Previously, an engine was devised and patented that has a tandem-piston arrangement in which the mode of operation is to induct a fresh fuel-air charge into a cavity that is opened between the lower surface of a motor piston and the upper surface of a charger piston as they descend in a cylinder. When the pistons rise, the fresh charge is compressed between the pistons in a space called the charger cavity for injection into the combustion chamber, which is located above the motor piston. Injection is through transfer channels running upward past the motor piston along the cylinder wall that are opened as the motor piston rises past them when it nears its zenith. Injection and combustion take place as the motor piston passes its top center position. The transfer channel openings are then closed by the lower motor-piston ring as it descends early in the power stroke while the upper surface of the charger piston is in tight full-surface contact with the lower surface of the motor piston. The patent number is U.S. Pat. No. 5,509,382; it issued in 1996, and it is titled: *Tandem-Differential-Piston Cursive Constant-Volume Internal-Combustion Engine*. For simplicity, the engine that is described in U.S. Pat. No. 5,509,382 will now be referred to as a tandem-piston engine.

BRIEF SUMMARY OF THE INVENTION

Continuing design and engineering work on the tandem-piston engine has shown the need for several improvements, which have been made.

Investigation of heat balance measurements in four-stroke engines led to the derivation of a means for estimating the indicated thermal efficiency of internal-combustion engines. The indicated efficiency is found in terms of the heat losses as a function of the engine speed and the temperature of the interior combustion chamber surfaces by the following formula:

$$\eta=[1-(1/E)^{k-1}]\cdot e^{-KALt}$$

It shows that the standard formula, $\eta=1-(1/E)^{k-1}$, for estimating the adiabatic efficiency, $\eta$, of an engine; that is, when no heat is lost into the chamber surfaces, may be multiplied by an exponential cooling factor, $e^{-KALt}$, to find the expected indicated efficiency of the engine when there is heat being lost into the interior chamber surfaces.

In the formula, E is the expansion ratio, k is the ratio of specific heats, and K is a cooling constant having a value of 3.8 for an engine having a cylinder with a bore of around 76 mm (2.99 in.) and a stroke of 75 mm (2.95 in.). A is a thermal coefficient. It is calculated by using the average temperature of the combustion gases during the power stroke, about 2000 kelvin, subtracting the average interior combustion chamber surface temperature, about 500 kelvin, and then dividing the difference by the average temperature of the combustion gases. This gives it a value of about 0.75 in a small four-stroke engine. But in an engine such as the latest version of the tandem-piston engine, which has hot insulated combustion chamber surfaces, its value will decrease to around 0.25. The square root of the engine speed in revolutions per second is L, and t is the time for the stroke in seconds.

Using the formula derived for estimating the indicated efficiency, it was found that the engine as shown in the earlier patent, which only had an 11.8 to 1 expansion ratio, would only have a brake efficiency of around 38% or less, partly because the expansion ratio was far too low. Also, the insulators separating the various components in the motor piston, the piston valve and the cylinder head were not thick enough to prevent the fast transfer of large quantities of heat away from the combustion gases.

Calculations showed that an expansion ratio in the neighborhood of 25 or 30 to 1 would be necessary for very high efficiency. A new version of the tandem-piston engine was designed in which the actual stroke of the charger piston was increased to 72 mm (2.835 in.). Then the stroke of the motor piston was increased to two-thirds of the actual stroke of the charger piston, 48 mm (1.89 in.), leaving 24.77 mm (0.975 in.) for the effective charger stroke because the motor piston leads the charger piston in phase by 6 degrees. An expansion ratio of 30 to 1 was obtained by adjusting the volume of the combustion chamber for high-pressure operation while also including the expansion volume of the piston valve.

Thermal calculations then showed that far more insulation would be necessary to prevent heat loss from the combustion gases into the cylinder crown, piston crown and valve crown. These were redesigned to incorporate slabs of medium density zirconium phosphate of 19 mm (0.75 in.) for the cylinder crown and 12 mm (0.472 in.) for both the piston crown and the valve crown. This material is a machinable ceramic that is rated for use up to 1811 kelvin in air. It has a very low thermal conductivity, 0.9 watt/meter-kelvin, and a very low coefficient of thermal expansion, 0.9 micro-meter/meter-kelvin, which gives it an ultra high thermal shock resistance. The low coefficient of thermal expansion also allows it to be held in compression by clamping during high temperature operation. The bezels that hold the piston crown and valve crown were made of titanium for mass reduction and to use its low thermal conductivity to reduce the loss of heat from the combustion chamber.

The ceramic piston crown has a ledge with a conical upper surface near its perimeter with its vertex at the center of the lower supporting surface. The bezel that holds the ceramic piston crown has a mating conical surface. Since the vertex of the conical upper surface emanates from a point at the center of the lower supporting surface of the crown, then thermal expansion by either the ceramic piston crown or the bezel will neither loosen nor tighten the hold along the conical surface. There will be sliding contact from expansion by either. The bezel is also firmly fitted and tightened against the ceramic crown so as to hold it in compression by its outer surfaces since the ceramic is much stronger in compression than in tension. It is believed that the thermal expansion in the ceramic crown, which will operate at very high temperatures, will exceed the thermal expansion of the bezel, which is expected to operate around 400 to 500 kelvin. However, since the expansion coefficient of the ceramic is very low, the bezel could perhaps expand more, in that event, the crown will still be held firmly at the conical ledge. The valve crown was similarly redesigned with a ledge with a conical upper surface having its vertex at the center of its lower surface although the angle of the cone where the valve bezel holds it is much steeper.

The motor piston was also modified to give it a simple conical lower surface instead of the compound lower surface that was flat with a conical rim, which was used previously. This allows it to be thick in the center but much thinner at the outer edge thereby providing it with sufficient strength but less mass while it also reduces the length required for the transfer channels along the cylinder wall. The single conical surface is also easier to match with a single conical surface on the charger piston to effect total charge transfer.

The upper motor-piston ring has parallel conical surfaces. This form is used at the top of the piston bezel to polish the cylinder bore along the entire exposed section because it is believed that less heat will be absorbed where it is specularly polished. It is intended that the piston bezel be made of titanium for less mass; however, if titanium should prove to be unsuitable, it may be made of steel. The top valve ring and the valve bezel are similar in design and purpose.

The piston rod was redesigned to include a crosshead on its lower end that slides in a crosshead guide that is machined into the lower part of a redesigned charger piston so as to provide direct lateral support adjacent to the wrist pin. A strong lateral force is developed at the wrist pin as the motor connecting rod converts the vertical force from the piston rod into the rotaiy motion of the crankshaft. The lateral force will now be transmitted straight through the crosshead, the crosshead guide, and the wall of the charger piston to the cylinder wall without generating a twisting moment through the central piston rod boss. The original cantilever piston rod design lacked direct support for the lateral force at the wrist pin and it was thought that the force and wear might be excessive between the piston rod and piston rod boss. The new design should also effectively remove most lateral force from the motor piston. This arrangement is an improvement over the use of a conventional crosshead guide, which would need to be mounted in the cylinder block or upper part of the crankcase below the extent of piston travel, and which if used, would entail a substantial increase in the height of the engine. It would also entail an increase in the length of the charger connecting rods that would make them long and spindly. Another advantage of using a crosshead guide that is mounted in the charger piston is that the travel of the crosshead along a crosshead guide that is mounted in the charger piston is reduced to only the difference in stroke between the motor piston and the charger piston. In the present design, the stroke of the motor piston is two-thirds of the stroke of the charger piston so the travel of the crosshead along the crosshead guide is reduced to only one-half as much as it would be if the crosshead were to be mounted in the cylinder block in the typical fashion while the sliding velocity of the crosshead along the crosshead guide is also reduced by half. Another advantage of having the crosshead guide in the charger piston is that it is being pulled downward by the charger crankpins from the charger connecting rods while the motor piston is pushing the motor crankpin down through the piston rod and the motor connecting rod. Therefore the force that is transferred to the cylinder wall from the reaction at the wristpin from the motor rod is being reduced by the reaction at the piston pins from pulling the charger piston down thereby reducing the frictional losses even further. When totaled, the frictional losses are thus reduced to a small fraction of those encountered when using a crosshead guide mounted to the cylinder block.

A comparison of the latest preferred embodiment of the tandem-piston engine with a four-stroke engine having the same size main cylinder shows the following differences in operation and calculated performance:

1. It inducts only about one-third as much fresh charge, but it does it every revolution instead of once for every two revolutions as in a four-stroke cycle engine.
2. It has insulated combustion chamber surfaces that operate at from 1000 to 1500 kelvin to prevent the absorption and wasting of as much heat from the hot combustion gases.
3. It completely burns its fuel unless there is excess fuel in the charge.
4. It needs only a small fan for external cooling instead of a heavy, bulky liquid cooling system.
5. It uses a 30 to 1 expansion ratio to transform nearly 60% of the heat released by combustion into indicated mechanical work.
6. It has a power stroke with every revolution so it needs only half as many cylinders for equally smooth power delivery.
7. Its power output is comparable for the same cylinder size.
8. It uses low octane gasoline.
9. Its maximum brake thermal efficiency was calculated at 50%.

DETAILED DESCRIPTION OF THE INVENTION

Figure 1:
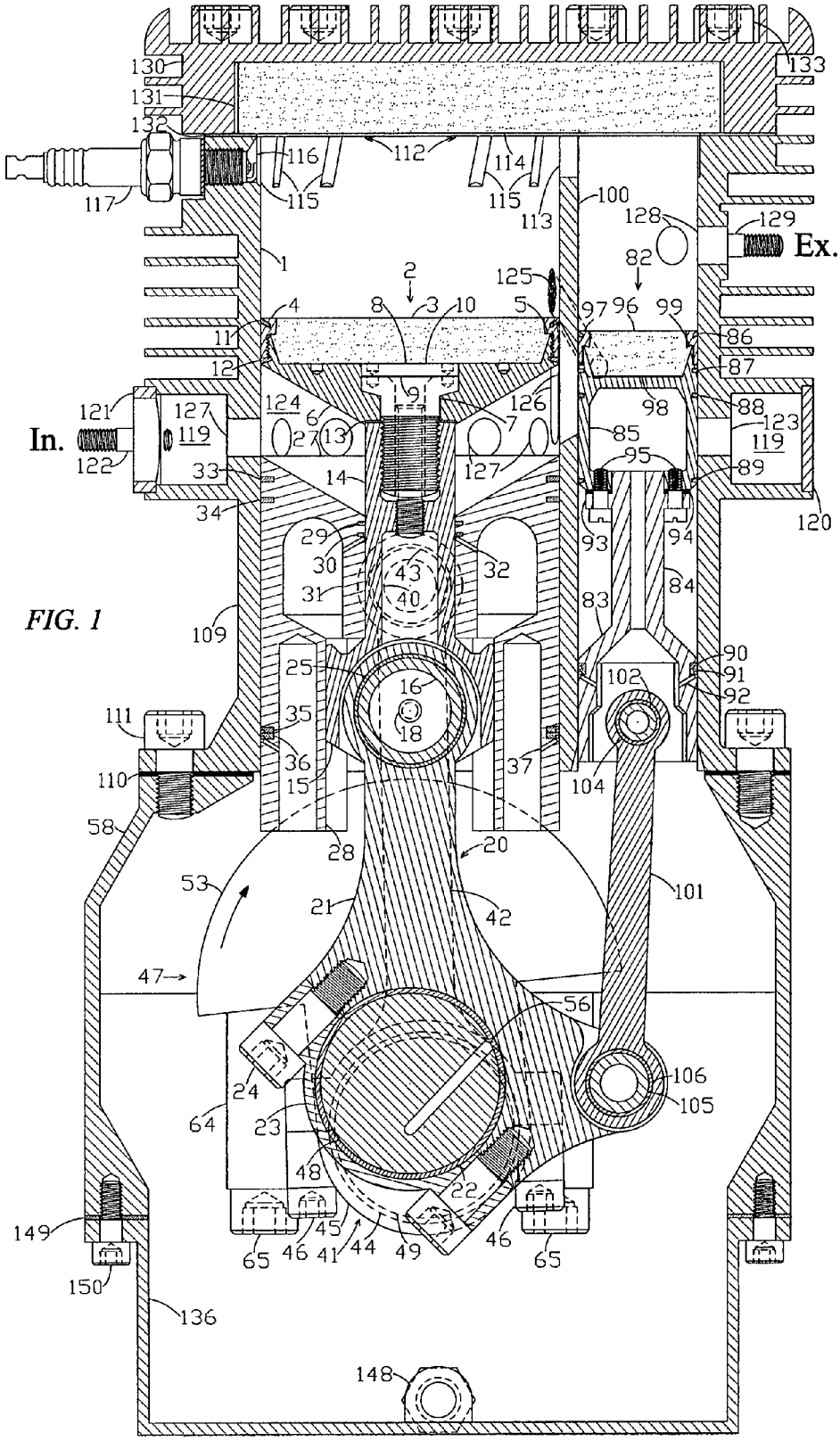
FIG. 1 is a full section view from the front of the small tandem-piston utility engine with the crank angle at 180 degrees AMTC; crankshaft rotation is clockwise.
Figure 2:
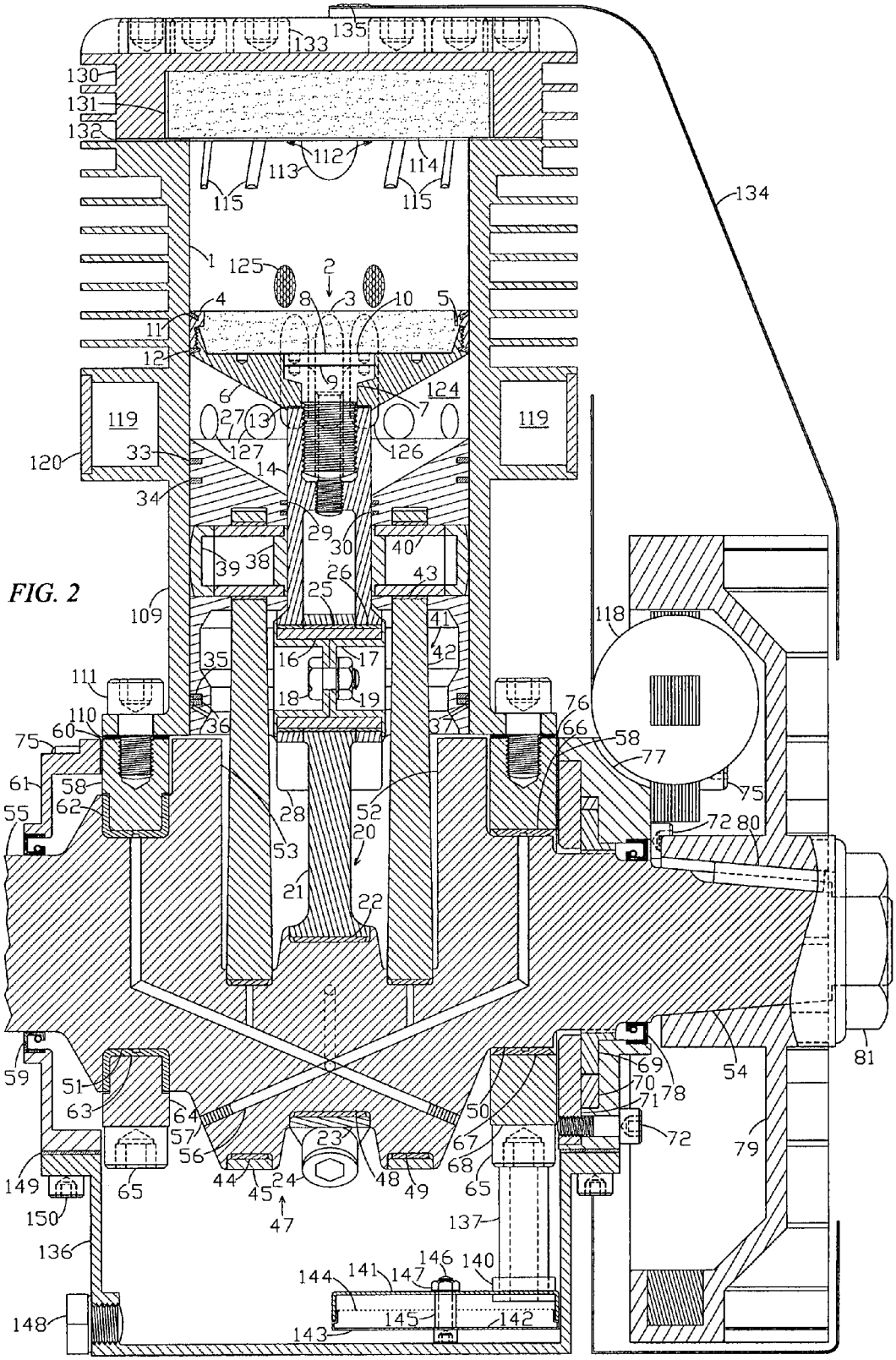
FIG. 2 is a full section view from the left side of the small tandem-piston utility engine with the crank angle at 180 degrees AMTC.
Figure 3:
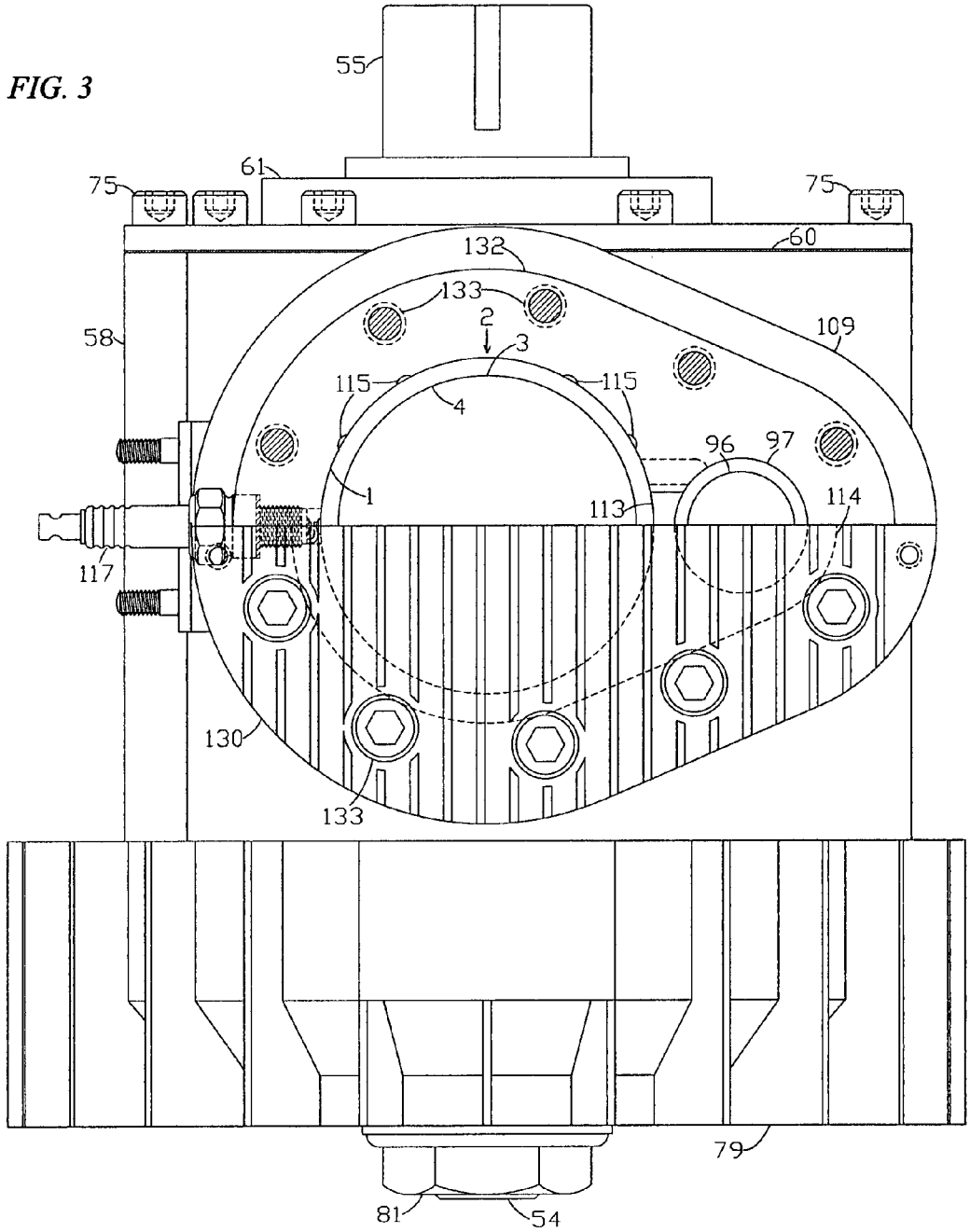
FIG. 3 is a half section top view of the engine after removing the cooling shroud, and a half section top view of the engine with the cylinder head removed.
Figure 4:
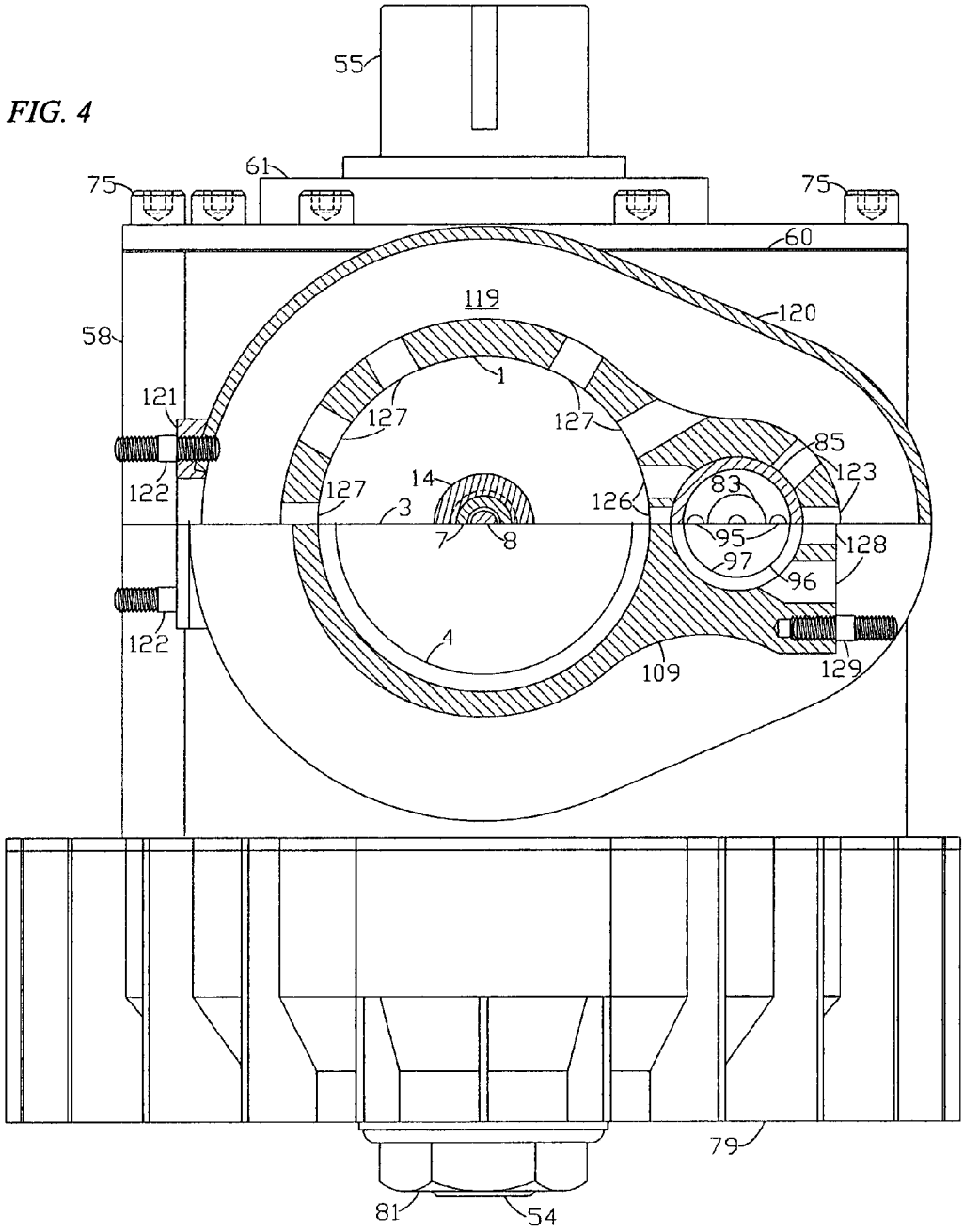
FIG. 4 is a half section view of the engine from the top with the sectioning through the exhaust ports in the upper part of the cylinder block. It also shows a half section view of the engine from the top with the sectioning across the intake manifold, the main intake ports, the middle intake ports, and the valve intake ports.
Figure 5:
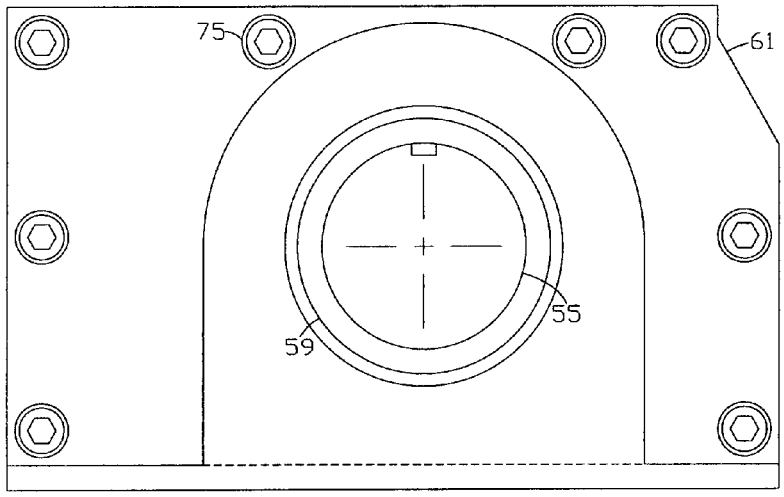
FIG. 5 is a view from the rear of the rear crankcase cover of the engine.
Figure 6:
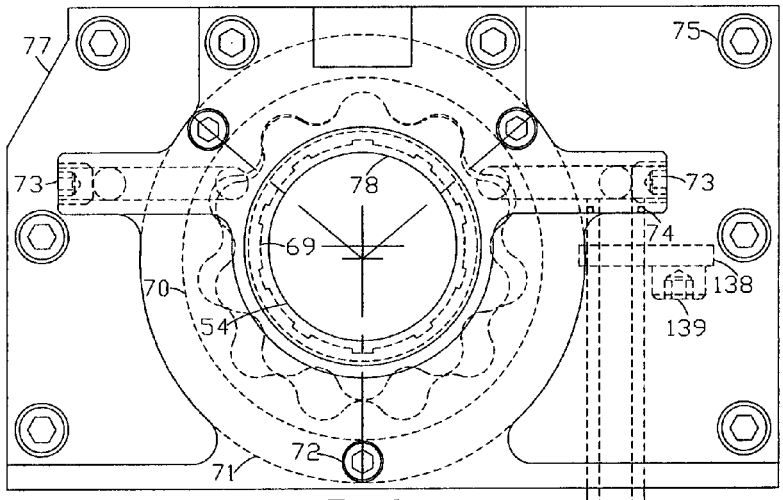
FIG. 6 is a front view of the front crankcase cover of the engine.
Figure 7:
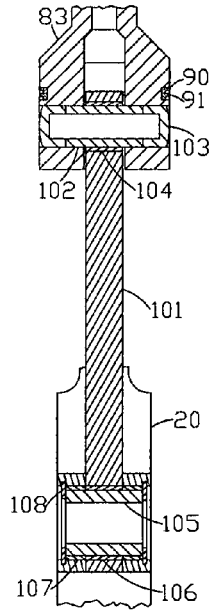
FIG. 7 is a section view through the link rod viewed from the right side of the engine showing its connection to the motor connecting-rod shank and the piston valve.
Figure 8:
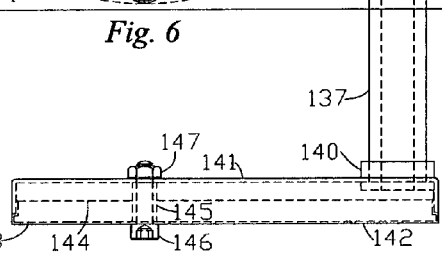
FIG. 8 is a section view from the top of the engine through the wrist pin and its supporting crosshead and the crosshead guide that is machined into the lower part of the charger piston.
Figure 8:
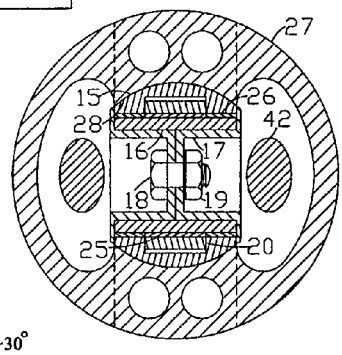
Figure 9:
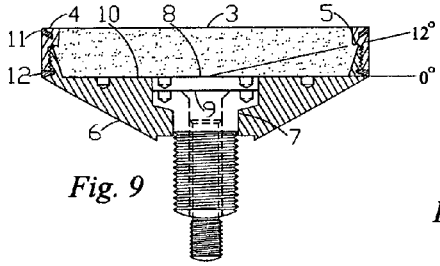
FIG. 9 shows the motor-piston assembly with a line indicating the point of origin at the center of the lower surface of the piston crown for the conical upper surface on the ledge near the perimeter of the crown that is used for clamping by the piston bezel.
Figure 10:
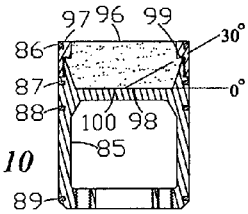
FIG. 10 shows the valve-head assembly with a line indicating the point of origin at the center of the lower surface of the valve crown for the conical upper surface on the ledge near the perimeter of the crown that is used for clamping by the valve bezel.

Referring now to the drawings in detail, FIGS. 1 through 10. The engine has a main cylinder 1 that is fitted with a motor piston 2 of the crosshead type having a ceramic piston crown 3 that is clamped to it by a piston bezel 4. A conical upper surface on the piston-crown ledge 5 that has its vertex at the center of the lower surface of the piston crown is used by a mating conical lower surface on the piston bezel 4 to hold the piston crown 3 against a pistoncrown shim 10 that covers a titanium motor-piston base 6 and a locking-bolt 8. A piston-rod shim 13 is used to adjust the spacing of the motor-piston base 6 on a hardened and tempered steel piston rod 14 while a base bolt 7 clamps them together, and the locking bolt 8 with its height adjusted by a locking-bolt shim 9 prevents it from loosening. The piston-rod shim 13 must be chosen of the correct thickness to assure that the upper surface of the charger piston 27 firmly contacts the lower surface of the motor-piston base 6 at 17 degrees AMTC when a lower motor-piston ring 12 closes the entrance to the transfer channels 115. The motor piston 2 has an upper motor-piston ring 11 that has conical upper and lower surfaces. The lower motor-piston ring 12 has a conical lower surface. The piston rod 14 has a crosshead 15 at its lower end, and a wrist pin 16 passes through it. The wrist pin 16 is held in place by wrist-pin keepers 17, a keeper bolt 18, and a keeper nut 19.

A motor connecting rod 20 has a motor-rod shank 21, motor-crankpin insert bearings 22 and a motor-rod cap 23 that is held in place by motor-rod bolts 24. The upper end of the motor-rod shank 21 has an inner wrist-pin bushing 25 for the center section of the wrist pin 16 to turn in while its outer ends turn in outer wrist-pin bushings 26 that are fitted to the lower end of the piston rod 14 so that the wrist pin 16 pivotally connects the piston rod 14 to the motor connectina rod 20.

An aluminum charger piston 27 has a crosshead guide 28 machined into its lower part so that forces developed at the wrist pin 16 may be transferred through the crosshead 15 to the crosshead guide 28 in the lower part of the charger piston 27 and from it to the walls of the main cylinder 1. The charger piston 27 has a central piston rod boss 31 that has a groove for a contracting compression ring 29 and another for a contracting oil-control ring 30 with central-boss oil drains 32. On its outer surface, it is fitted with a first charger compression ring 33, a second charger compression ring 34, an upper charger oil-control ring 35 and a lower charger oil-control ring 36 with skirt oil drains 37. Inner piston-pin retaining plugs 38 and outer piston-pin retaining plugs 39 are used to keep the piston pins 40 in place. The motor-piston base 6 has a simple conical lower surface and the charger piston 27 has a mating simple conical upper surface to give full contact with simplified machining while allowing the motor piston 2 to be thicker in the central part but thinner at its outer perimeter.

Charger connecting rods 41 have charger-rod shanks 42 with piston-pin bushings 43 pressed into their upper ends and charger-crankpin insert bearings 44 in their lower ends that are retained in place by charger-rod caps 45, and these are held on by charger-rod bolts 46.

A crankshaft 47 has a motor crankpin 48, charger crankpins 49, a front main journal 50, a rear main thrust journal 51, a front counterweight 52, a rear counterweight 53, a front shaft 54, a rear-output shaft 55 and crankshaft oil ducts 56, which are closed by oil-duct plugs 57. A crankcase 58 is closed by a rear-output-shaft seal 59 that is held in a rear crankcase cover 61 using a rear cover gasket 60. At the rear, the crankshaft 47 turns in an upper-rear-thrust-journal shell 62 and a lower-rear-thrust-journal shell 63 that are clamped to the crankcase 58 by a rear-thrust-journal cap 64 that is bolted on by journal-cap bolts 65. At the front it turns in an upper-front-journal shell 66 and a lower-front-journal shell 67 that are held in place by a front-journal cap 68.

Lubrication is facilitated by an oil-pump inner rotor 69 working inside an oil-pump outer rotor 70 that is fitted against an oil-pump back plate 71 that is held against a front crankcase cover 77 by back-plate bolts 72. A front cover gasket 76 is used to seal the front crankcase cover 77 to the crankcase 58 while crankcase-cover bolts 75 hold it on and a front-shaft seal 78 closes it. Oil-passage plugs 73 facilitate the machining of oil passages and an oil-pipe o-ring 74 seals the outlet.

A flywheel 79 is positioned by a flywheel key 80 and held securely by a flanged flywheel nut 81.

A piston valve 82 bas an aluminum valve body 83 with a valve shank 84 and a valve head 85 on which are fitted a second valve ring 87, a third valve ring 88, and a fourth valve ring 89. A top valve ring 86 is fitted to a valve bezel 97. The valve body 83 is fitted with a valve-oil-ring upper half 90 and a valve-oil-ring lower half 91 and it has valve oil drains 92 below them. The valve body 83 has a body flange 93 at its upper end, and valve-head shims 94 are used to mount the valve head 85 on it at the proper height where it is held in place by valve-head screws 95. A valve crown 96 is clamped down with its lower surface against a valve-crown shim 98 by a valve bezel 97 that bears against a conical upper surface on a valve-crown ledge 99 with its vertex at the center of the lower surface of the valve crown 96. The piston valve 82 reciprocates in a valve cylinder 100.

A link rod 101 is fitted with a gudgeon-pin bushing 104 and is attached by a gudgeon pin 102 to the valve body 83 where it is secured by gudgeon-pin retaining plugs 103. At the other end of the link rod 101, it is fitted with an inner-link-pin bushing 106 and attached to the motor-rod shank 21, which is fitted with outer-link-pin bushings 107, by a link pin 105 that is secured by link-pin keepers 108.

A cylinder block 109 sits on cylinder-block shims 110 and is held to the crankcase 58 by cylinder-block bolts 111. At its upper end there is a combustion chamber 112 and an exhaust passage 113, and it is closed at its upper end by a cylinder crown 114. Also there are 9 transfer channels 115 at its upper end, one of which has an ignition recess 116 where a spark-plug 117 is located. An ignition coil 118 provides a spark for ignition to start the engine. After the engine is running, recompressed hot gases provide ignition of the fresh charge as it enters the combustion chamber.

An intake manifold 119, which has a manifold cover 120 and a carburetor mounting flange 121 having carburetor mounting studs 122, surrounds the cylinder block 109. Valve intake ports 123 allow part of the fresh fuel-air charge to be drawn into the valve cylinder 100 from which it initially travels through upper intake ports 125 having flame arresting diffusers into the charger cavity 124. The upper intake ports 125 are blocked at their entrance in the valve cylinder 100 by the piston valve 82 during the period that their exit in the main cylinder 1 is exposed to hot combustion gases when the motor piston 2 is in the lower part of its stroke in order to prevent the possibility of ignition of the fresh fuel-air mixture in the valve cylinder 100. As the charger piston 27 proceeds downward, the fresh charge travels through middle intake ports 126 into the charger cavity 124. When the charger piston 27 is in the lower part of its stroke, the main intake ports 127 allow the final part of the fresh fuel-air charge to be drawn into the charger cavity 124 directly from the intake manifold 119. After ignition and expansion of the fuel-air charge in the combustion chamber 112, hot combustion gases leave through exhaust ports 128 flanked by exhaust-pipe studs 129.

A cylinder head 130 with a cylinder head liner 131 houses the cylinder crown 114 while head bolts 133 hold them tight against a head gasket 132 and the cylinder block 109. A cooling shroud 134 for directing air circulated by the flywheel 79 is held to the cylinder head 130 by shroud bolts 135.

An oil pan 136 is the reservoir for lubricating oil that is drawn in through the oil intake 143 of the strainer bottom 142 that is held to a strainer cover 141 by a strainer bolt 146 having a spacer 145 with a strainer nut 147. The oil then passes through a strainer screen 144 and an oil pipe 137, which is clamped to the strainer cover 141 by a clamping sleeve 140, having an oil-pipe flange 138 that is held to the crankcase 58 by a flange bolt 139. The oil pan 136 has an oil drain plug 148, and an oil pan gasket 149 provides the seal while it is clamped to the crankcase 58 using oil-pan bolts 150.

Figure 11:
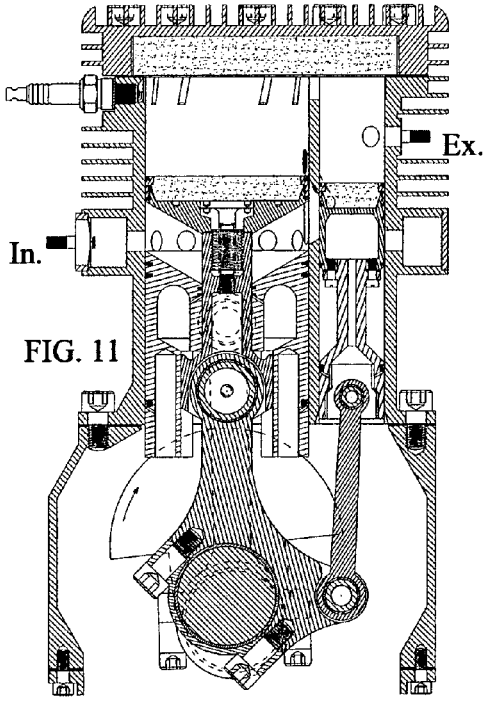
FIG. 11 shows the engine at 180 degrees AMTC when exhaust blowdown from the closing cycle is ending while filling of the charger cavity with a fresh fuel-air charge is being completed through the main intake ports.
Figure 12:
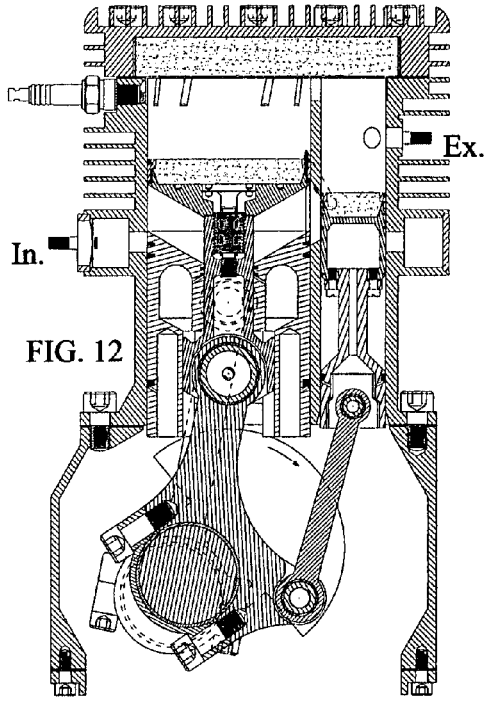
FIG. 12 shows the engine at 236 degrees AMTC when induction ends as the charger piston rises past the main intake ports; meanwhile, the rising motor piston and piston valve are forcing hot residual gases out of the exhaust ports.
Figure 13:
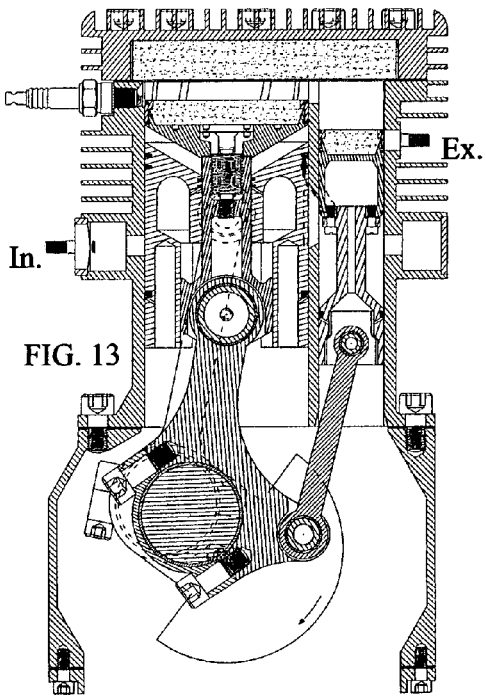
FIG. 13 shows the engine at 313 degrees AMTC as hot residual gases are trapped when the exhaust ports are closed by the rising piston valve; meanwhile, the fresh fuel-air charge is being compressed in the charger cavity.
Figure 14:
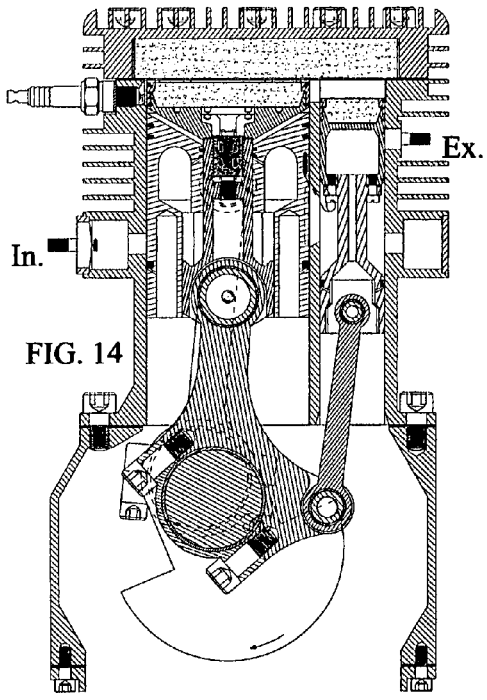
FIG. 14 shows the engine at 343 degrees AMTC when the lower motor-piston ring opens the nine transfer channel inlets so the compressed fuel-air charge can surge into the combustion chamber for ignition by the fiery residual gases.
Figure 15:
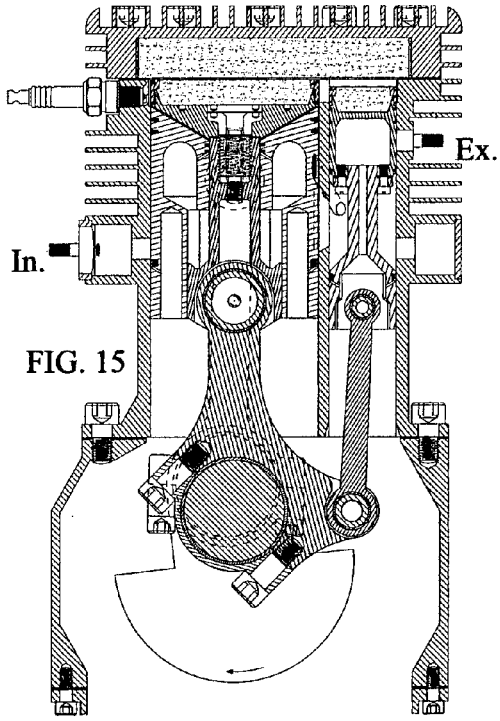
FIG. 15 shows the engine at MTC when the charger piston continues forcing the fresh fuel-air charge through the transfer channels into the combustion chamber where it ignites upon entry into the blazing combustion gases.
Figure 16:
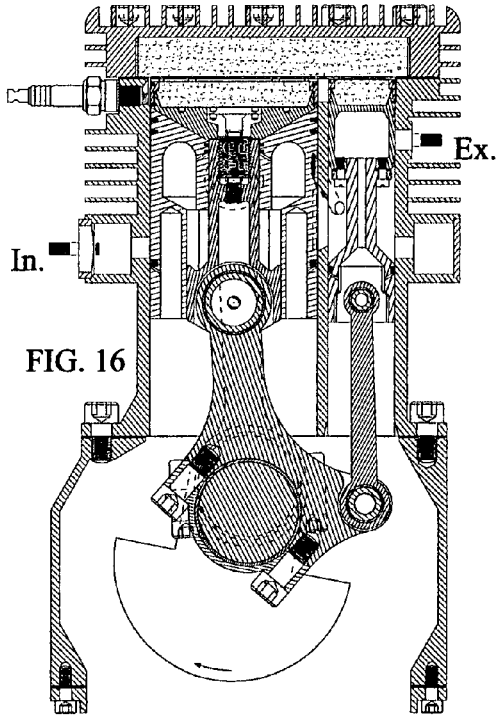
FIG. 16 shows the engine at 17 degrees AMTC during the power stroke when charge transfer ends as the lower ring of the motor-piston closes the inlets to the transfer channels while the pistons are meeting in tight full surface contact.
Figure 17:
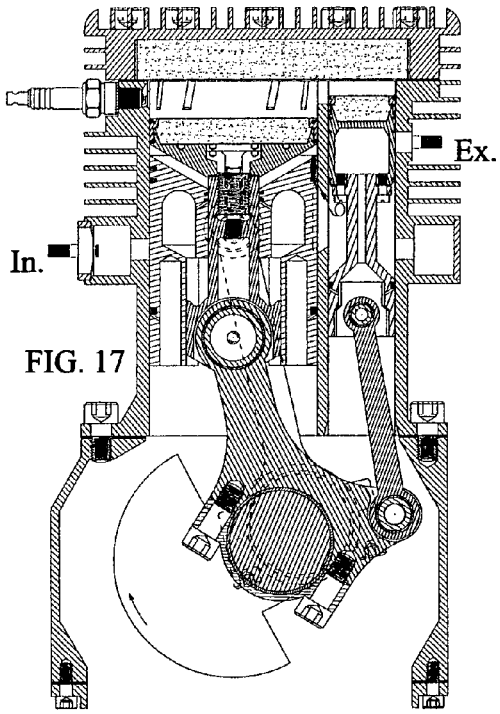
FIG. 17 shows the engine at 68 degrees AMTC during the power stroke when the charger piston starts opening the upper intake ports so that a fresh fuel-air charge can be drawn into the charger cavity through the valve cylinder.
Figure 18:
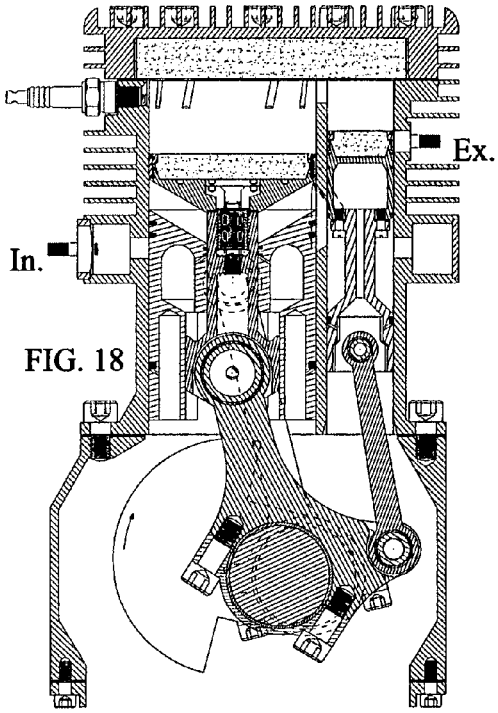
FIG. 18 shows the engine at 110 degrees AMTC when the piston valve opens the exhaust ports for exhaust gas blowdown while the power stroke ends; meanwhile, the fresh fuel-air charge enters the charger cavity via the middle intake ports.

In FIGS. 11 through 18, which show the engine with the pistons in each of eight key positions, engine rotation is given in degrees AMTC (after motor top center; that is, the number of degrees the crankshaft 47 has turned in a clockwise rotation after the motor piston 2 was at its top center position). Illustration of the cycle starts at 180 degrees AMTC. A fresh fuel-air charge is inducted into the charger cavity 124 that opens between the motor piston 2 and the charger piston 27 as they descend. As the pistons move upward, the charge is compressed and at −17 degrees AMTC (+343 degrees AMTC) the transfer channels 115 leading to the combustion chamber are opened as the lower motor-piston ring 12 rises past their lower edges. The compressed fuel-air charge then surges into the combustion chamber 112 where ignition takes place as it contacts the hot recompressed residual gases from the previous cycle that are trapped inside and are much hotter than the ignition temperature of the fuel. Injection continues until +17 degrees AMTC when the lower motor-piston ring 12 closes the entrances to the nine transfer channels 115 as the motor-piston 2 moves downward past their lower edges while the conical upper surface of the charger piston 27 meets the conical lower surface of the motor-piston base 6 in firm total contact. An extremely high ratio expansion then transforms about 55% to 60% of the heat energy put into the gases by combustion into indicated mechanical work. And after subtracting friction and pumping losses, around 45% to 50% of the heat input is expected to be available in the brake mechanical work output.

In the preferred embodiment design shown, the engine has an 80 mm (3.15 in.) bore, and the actual stroke of the charger piston 27 is 72 mm (2.835 in.), but the motor piston 2 has a stroke of 48 mm (1.89 in.) and it leads the charger piston 27 in phase by 6 degrees so the strokes must be subtracted geometrically. The difference in phase gives the charger piston 27 a net effective stroke of 24.77 mm (0.975 in.) compared to an actual stroke of 48 mm (1.89 in.) for the motor piston 2. However, the volume of the charger cavity 124 is reduced by one-ninth from a piston rod 14 that runs through it for mounting the motor piston 2. And the expansion volume is increased by the displacement of a piston valve 82. Thus, the volume of the expansion chamber totals to about 2.64 times the volume of the charger cavity.

The engine is lubricated by motor oil that is carried in its oil pan 136 as in most four-stroke engines, but it has a power stroke during each revolution so only half as many cylinders will be required for the same smoothness of power delivery. Elimination of the timing gears, camshaft, poppet valves, water pump, cooling fan and the extra revolution per cycle helps in keeping friction and pumping losses per revolution at about the level as four-stroke engines of equal power even though the expansion ratio is far greater. The friction and pumping losses were calculated at 35.0 joules per revolution at 3000 RPM for the tandem-piston engine. This is about the same as the losses per revolution for a four-stroke engine of the same power.

Because of the extremely hot conditions in the combustion chamber 112, it is assumed that there will be no appreciable amount of incomplete combustion unless there is excess fuel in the charge.

The volume of the combustion chamber 112 at contact, that is when the conical upper surface of the charger piston 27 is tightly against the conical lower surface of the motor-piston base 6 with injection of the charge complete, is 13 $cm^3$ (0.793 cu. in) so as to bring the peak pressure to around 7350 kPa (1066 psi), about the peak pressure in a conventional engine having a 12 to 1 compression ratio. And the total expansion volume when the motor piston 2 is at 186 degrees is 289 $cm^3$ (17.636 cu. in), which gives the engine a 22.2 to 1 expansion ratio from the contact position. However, the engine has a greater expansion ratio, 30 to 1, from its AMV (angle of minimum volume, which is at about 8 degrees after the motor piston 2 is at its top center position). It is expected that after injection begins at −17 degrees AMTC, the pressure will rise to a maximum level as the AMV is passed at about +8 degrees AMTC and continue for a few degrees until injection ceases when the conical upper surface of the charger piston 27 contacts the conical lower surface of the motor-piston base 6 at +17 degrees AMTC. Because the extraction of mechanical energy starts at the AMV, and the injection period ends about 9 degrees later, the expansion ratio will be calculated from the combustion chamber 112 volume at the AMV, but the adiabatic efficiency is treated as it is in a limited pressure cycle for a Diesel engine.

$$\eta=1-(1/E)^{k-1}[(\alpha\beta^k-1)/((\alpha-1)+k\alpha(\beta-1))],$$

wherein $\alpha$=the ratio of the maximum pressure to the compression pressure, and $\beta$=the ratio of the volume at the end of injection to the minimum chamber volume. The expansion ratio from the AMV of 30 to 1 would give the engine an adiabatic efficiency of about $1-(1/30)^{0.3}=64\%$. However since the engine operates in a limited pressure cycle, the figure is reduced to about 63%.

The exhaust starts opening at 110 degrees AMTC (70 degrees before the motor piston 2 is at bottom center). With this timing, the piston valve 82 then closes the exhaust ports 128 at 310 degrees AMTC and about a quarter of the residual gases that are left in the expansion volume after blowdown, 0.0726 liters (4.43 cu. In.), are trapped. The residual gases are then recompressed into the combustion chamber 112 so as to provide ignition of the next charge during its injection and to absorb part of the heat of combustion so as to buffer the temperature rise; thereby suppressing the loss of heat as well as the generation of nitrogen oxides.

The fresh charge at full load is considered to fill the charger cavity 124 to a pressure varying from 93 kPa (13.5 psi.) at 1000 RPM to 86 kPa (12.5 psi.) at 4000 RPM. A temperature of 293 kelvin (20 degrees Celsius) was used because the charge is cooled by fuel evaporation, and while the charger cavity 124 is fairly warm, it has no extremely hot valves, hot surfaces or residual gas. Assuming an intake manifold 119 temperature of 288 kelvin (15 degrees Celsius), this gives 90% volumetric efficiency at 1000 RPM or 83% volumetric efficiency at 4000 RPM.

In the tandem-piston engine, the fuel-air charge that is transferred from the charger cavity 124 into the combustion chamber 112 during about 35 degrees of crankshaft rotation, is only about one-third as large as the fuel-air charge that is inducted and compressed in a four-stroke engine of the same power. This is because a charge is transferred during each revolution, and the thermal efficiency is expected to be around 50% greater since less heat is lost by forced convection and the expansion ratio is far higher.

Even though the maximum pressure in this engine is expected to be around 7350 kPa (1066 psi) as in a 12 to 1 compression ratio conventional engine, it is not expected that it will have a requirement for high-octane gasoline. This is because any fuel-air mixture that has been transferred into the combustion chamber 112 is aflame as it enters, but any fuel-air mixture that is still in the charger cavity 124 is squeezed into an extremely thin layer between the conical upper surface of the aluminum charger piston 27 and the conical lower surface of the titanium motor-piston base 6 and neither surface is very hot. Preignition or detonation of the fuel-air mixture before it has left the charger cavity 124 should be effectively precluded by its intimate contact with the relatively cool metal surfaces; so it is expected that gasoline of very modest octane levels will suffice.

Because of the recapture and recompression in the combustion chamber 112 of a substantial volume of hot residual gas, which when recompressed will almost certainly be above the ignition temperature of the fresh charge, it is believed that throttling will generally not be necessary in the tandem-piston engine. It should be possible to control the load by varying the amount of EGR (exhaust gas recirculation) in the fresh charge, unless perhaps it is desired to operate it partially throttled when it is idling for smoother operation. This will allow most operation to be done with a stoichiometric mixture with EGR for cleaner operation. Maximum load is expected at about $\alpha$=0.8 ($F_R$=1.25) when more torque than economy is desired; however, it is expected that a stoichiometric fuel-air mixture at $\alpha$=1 ($F_R$=1) will give about 97% of the maximum load while burning only 80% as much fuel.

Since combustion of the fresh fuel-air charge is expected as it is injected, it is not necessary to keep the combustion chamber 112 cool as it is in the Otto cycle, so it may be operated at a very high temperature that is limited only by the insulating and refractory characteristics of the materials used for the cylinder crown 114, piston crown 3 and valve crown 96. These may be made of medium density zirconium phosphate, a machinable ceramic that is rated for use up to 1811 kelvin in air. This ceramic has a very low thermal conductivity, 0.9 watt/meter-kelvin, and a very low coefficient of thermal expansion, 0.9 micro-meter/meter-kelvin, which gives it an ultra high thermal shock resistance. The low coefficient of thermal expansion also allows it to be held in compression by clamping during high temperature operation. The piston bezel 4 and the valve bezel 97 that hold the piston crown 3 and valve crown 96 respectively are made of titanium for mass reduction and to use its low thermal conductivity to reduce the loss of heat from the combustion chamber.

Because the cylinder block 109 is externally cooled by air, its operating temperature is estimated to be around 500 kelvin. This will enable lubrication of the engine by petroleum oil in the usual manner. And with the piston crown 3 being machined from an insulating ceramic material, the upper motor-piston ring 11 and the lower motor-piston ring 12 will not be required to transmit nearly as much heat into the cylinder block 109 as the rings are required to do in conventional engines. This will allow smaller ring gaps and closer piston fitting while piston ring and cylinder wall life should be improved.

I claim:

1. In an internal-combustion reciprocating engine, wherein the improvement comprises:

(a) a piston crown that has a ledge with a conical upper surface near its perimeter wherein the vertex of the conical upper surface is at the center of the lower supporting surface of the piston crown, and (b) a piston bezel that has a mating conical lower surface for clamping against the conical upper surface on the ledge of the piston crown to provide for sliding contact along the mated conical surfaces that neither tightens nor loosens when there is unequal thermal expansion between the piston crown and the piston bezel because the angle of a conical surface does not change from thermal expansion.

2. In a two-stroke pump-compression cycle internal-combustion reciprocating engine having a main cylinder, a crosshead-type motor piston that is mounted on the upper end of a piston rod that has a pivotal connection at its lower end to the upper end of a motor connecting rod that is rotatably attached at its lower end to a motor crankpin on a crankshaft with vertical forces derived from gas pressure on the upper side of the motor piston causing lateral forces to be induced by the connecting rod against the pivotal connection to the piston rod as the motor piston reciprocates in the main cylinder while the crankshaft rotates, a charger piston having a centrally located hole through which the piston rod slides and means for reciprocation of the charger piston along the piston rod below the motor piston in the main cylinder, wherein the improvement comprises:

(a) a crosshead that is mounted on the lower end of the piston rod near the pivotal connection, and (b) a crosshead guide that is mounted within the charger piston so that the crosshead is supported against lateral forces without increasing the height of the engine while the travel of the crosshead along the crosshead guide is limited to the difference between the stroke of the charger piston and the stroke of the motor piston as it reciprocates in the main cylinder and the charger piston reciprocates along the piston rod below the motor piston in the main cylinder while lateral forces induced by the connecting rod are pushing through the pivotal connection against the piston rod and transferred through the crosshead, the crosshead guide, the wall of the charger piston and thence to the wall of the main cylinder.

* * * * *